US007543425B2

(12) United States Patent
Monti

(10) Patent No.: US 7,543,425 B2
(45) Date of Patent: Jun. 9, 2009

(54) MACHINE FOR PACKAGING ARTICLES INTO BOXES

(75) Inventor: Giuseppe Monti, Pianoro (IT)

(73) Assignee: Marchesini Group S.p.A., Pianoro (Bologna) (IT)

( * ) Notice: Subject to any disclaimer, the term of this patent is extended or adjusted under 35 U.S.C. 154(b) by 0 days.

(21) Appl. No.: 12/018,314

(22) Filed: Jan. 23, 2008

(65) Prior Publication Data

US 2008/0196360 A1 Aug. 21, 2008

(30) Foreign Application Priority Data

Feb. 15, 2007 (IT) ..... BO2007A0086

(51) Int. Cl.
*B65B 43/26* (2006.01)
*B65B 43/14* (2006.01)

(52) U.S. Cl. ..... 53/564; 53/457; 53/381.1

(58) Field of Classification Search ..... 53/381.1, 53/382.2, 382.3, 564, 566, 457, 458
See application file for complete search history.

(56) References Cited

U.S. PATENT DOCUMENTS 1,873,059 A * 8/1932 Smith et al. ..... 53/73
3,060,654 A * 10/1962 Lubersky et al. ..... 53/458
3,863,423 A * 2/1975 Bergstein et al. ..... 53/413
4,430,068 A * 2/1984 vom Hofe et al. ..... 493/100
4,569,184 A * 2/1986 Strombeck ..... 53/564
5,042,231 A * 8/1991 Konrad et al. ..... 53/458
5,473,868 A * 12/1995 Antonio ..... 53/566
5,715,657 A * 2/1998 Mondani et al. ..... 53/457
5,842,328 A * 12/1998 Kinoshita ..... 53/565
6,629,403 B1 * 10/2003 Tisma ..... 53/502

(Continued)

FOREIGN PATENT DOCUMENTS

DE 19720711 A 11/1998

(Continued)

OTHER PUBLICATIONS

International Search Report.

*Primary Examiner*—Paul R Durand
(74) *Attorney, Agent, or Firm*—William J. Sapone; Coleman Sudol Sapone P.C.

(57) ABSTRACT

In a machine for packaging articles into boxes, a magazine of flat folded tubular blanks is shifted with respect to a conveying line of boxes obtained in an inlet station, by a roto-translating arm for withdrawing blanks and introducing the withdrawn blanks into holding modules, associated to the conveying line. The initial part of the conveying line is situated at an inlet station, while the terminal part of the conveying line corresponds to a discharge station of the boxes already filled with articles. Along the conveying line, a pick-and-place system picks up articles from a feeding line and introduces the articles into the boxes, which are closed before reaching a discharge station. The feeding line and the articles outlet line are arranged, during the machine construction, according to a position of the same machine with respect to the production line, that is in order to allow coupling of the machine with working units, arranged aligned or perpendicular with respect to the machine. The described arrangement of the magazine and of the conveying line allows reducing machine height and improving the accessibility to parts of the machine, as well as improving ergonomic characteristics.

27 Claims, 16 Drawing Sheets

U.S. PATENT DOCUMENTS

| | | | | |
|---|---|---|---|---|
| 6,915,622 | B2 * | 7/2005 | Spatafora | 53/458 |
| 7,316,642 | B2 * | 1/2008 | Martelli | 493/309 |
| 7,392,630 | B2 * | 7/2008 | Ford | 53/48.1 |
| 7,401,453 | B2 * | 7/2008 | Ford | 53/543 |
| 7,418,809 | B2 * | 9/2008 | Martelli | 53/564 |
| 2006/0042188 | A1 | 3/2006 | Ford | |
| 2008/0098695 | A1 * | 5/2008 | Monti | 53/381.1 |

FOREIGN PATENT DOCUMENTS

| | | | |
|---|---|---|---|
| DE | 10203459 | A | 7/2003 |
| DE | 102005023810 | A | 11/2006 |
| EP | 1008517 | A | 6/2000 |
| JP | 05254515 | A | 10/1993 |
| JP | 2002068105 | A | 3/2002 |
| WO | WO9936317 | A1 | 7/1999 |

* cited by examiner

78A
M
78B
LA

78A 78A
78B

MACHINE FOR PACKAGING ARTICLES INTO BOXES

FIELD OF THE INVENTION

The present invention refers to a machine for packaging articles into boxes.

In particular, the present invention concerns a machine, in which boxes, that are later filled with articles, are obtained from flat folded tubular blanks, placed in a magazine.

BACKGROUND OF THE INVENTION

There are machines for automatic packaging of articles into containers or boxes, that in some cases can require previous introduction of a support into the box, since the particular container conformation does not allow the article to be placed firmly therein. An example is constituted by some containers used in the cosmetics field.

Moreover, in these cases, the article must be treated and must remain in a vertical position, as it is the only configuration that allows easy handling. Consequently, also during the introduction into the boxes, the articles must be in vertical position and the boxes must also be conveyed in the vertical position.

The used boxes are usually made of cardboard or paperboard, and just in the cosmetics and perfumery field they often have decorative treatments on the outer walls, that make them particularly delicate and subjected to scratches and easy damages.

Therefore, particular attention is required during their handling, considering also that, as it is well known to those skilled in the art, in the machines under consideration, the articles are conveyed by mechanisms of different type, with different transfers, and must be subjected to the effects o the mechanical actions of their handling.

The boxes are obtained from tubular blanks stored, in flat folded configuration, within a magazine, situated in the machine initial area. Means for withdrawing and opening the blanks are situated between the magazines and a conveying line, aimed at receiving the boxes and at conveying them through different operational stations.

Normally, the magazine is situated above the conveying line. This positioning causes a first problem deriving from the fact that particles of cardboard, dust and other impurities present between the blanks or formed during their withdrawal, fall right onto the conveying line, causing all the problems, known to those skilled in the art, that can result therefrom.

Another negative aspect lies in the fact that the positioning of the magazine above the conveying line causes the increase of the magazine height, making it more difficult to reach and affecting negatively the ergonomic characteristics of the machine in general.

Also the means for withdrawing and opening the blanks often do not facilitate an easily accessible positioning of the magazine, and often do not facilitate the placing of these elements, especially if the blanks are stored side by side on one edge and the machine must fill the boxes in vertical position.

The problem appears more noticeable if, in addition to the magazine of blanks, there is another magazine of elements of ribbed material, used for the preparation of supports for the articles to be introduced into the boxes.

The ergonomic aspect of the machine is negatively affected also by the conformation of the conveying line, which must leave the lower head of the boxes accessible for their closure, and thus it must extend along a loop path that passes below the closing means. This causes an increase of the vertical dimension of the loop path, increasing also the height of the active run of the conveying line, making it less easily accessible, and increasing the height of the machine in general too.

Another problem of this type of machines concerns the feeding of articles to be packaged and the removal of the boxes already packaged with the articles.

The articles are often supplied using a part of line, for example going out of the machine producing the articles, arranged in longitudinal alignment with the packaging machine. On the other hand, the point in which the articles reach the packaging machine is often situated on the machine side, according to a direction transversal with respect to the machine extension.

This requires a positioning of the packaging machine with perpendicular orientation with respect to the producing machine, with obvious difficulty in reasonable handling of the spaces for the machines placing.

In other cases, the arrangement of the machine disposed transversely with respect to the production line, becomes a need, which not always can be satisfied by the machines available at present, due to their specific constructive configuration.

The same problem occurs downstream of the machine, for the delivery of the articles already inserted into the boxes. The apparatuses working downstream of the machine are often arranged in line, i.e. aligned with the packaging machine. However, it often happens that it is necessary to withdraw the filled boxes along a direction transversal to the machine.

If, for example, the machine is oriented transversal with respect to the production line, also the products outlet line could be oriented at 90 degrees.

Likewise, this necessity causes serious difficulties in positioning the machines and dealing with the available spaces or, in other cases, it cannot be satisfied.

A further problem, that negatively affects the machine productivity, especially set up times, when the type of used package is changed, relates to the arrangement of the means aimed at placing an informative leaflet in the package together with the articles.

The leaflet can be placed before the article introduction, keeping it horizontal above the box, while the article is being inserted, dragging the sheet, which remains under the article bottom with the two ends extending upwards along the box sides.

Otherwise, the sheet can be placed folded above the article already inserted into the box, remaining then held in place by the cover of the closed box.

When the configuration is changed, because of the change of the product under process, it is necessary to change the motion of the leaflet placing means, and often to substitute parts thereof, adapting different elements to different operation.

SUMMARY OF THE INVENTION

The object of the present invention is to propose a machine, which can be easily associated to other machines or working means as easily as possible, with the least constraints to the positioning for the machine proposed by the invention, as well as for other machines or working means.

From this aspect, it is a particular object of the invention to propose the machine, which can be easily associated to a supplying line of articles to be packaged, possibly aligned with the packaging machine, and with a delivery line for the packaged articles, otherwise arranged perpendicular to the claimed machine or aligned longitudinally therewith.

Another object of the present invention is to propose a machine for packaging articles into boxes, equipped with devices that protect the integrity of the boxes walls surfaces, in particular when they have decorative elements or precious finishes.

A further object is to propose devices for conveying the boxes, so as to keep them always in vertical position, after their withdrawal from the magazine.

A still further object of the present invention is to propose a machine configured in such a way as to allow to lower the positions of the magazines of blanks and of sheets of ribbed material, maintaining at the same time the conveying line and means associated thereto as clean as possible.

A yet further object of the present invention is to improve in general the machine ergonomic characteristics, making some work areas more accessible for the operators, thus in general lowering the levels at which these areas are situated.

Another object of the invention is to reduce the time for adapting the machine during size change over of the articles and boxes being handled, making easier and quicker the arrangement of the means for placing the informative leaflet according to the placing way.

More in general, the object of the present invention is to propose a machine configured in such a way as to improve its ergonomic and productive characteristics, reducing, where possible, manufacture and maintenance costs, as well as the time for operations that become necessary each time.

These and other objects are obtained by a machine for packaging articles into boxes, said machine including:

at least one magazine of blanks in flat folded tubular configuration, having lateral flaps and closing wings;

an inlet station situated near said magazine of blanks;

blank withdrawing means for withdrawing and opening the blanks, so as to obtain boxes with open ends;

a conveying line for the boxes, situated with an initial part in correspondence to the inlet station;

a feeding line of the articles to be placed into the boxes along said conveying line;

article withdrawing means for withdrawing articles from the articles feeding line and for introducing the articles into the boxes;

boxes closing means, acting along said conveying line;

a box discharge station for discharging the boxes filled with the articles, situated at an end of said conveying line; wherein:

said articles feeding line extends beside the machine according to different possible configurations, to allow said machine to couple with working units arranged aligned or perpendicular therewith;

said box discharge station for discharging boxes filled with the articles includes a first outlet line, arranged at 90 degrees with respect to the boxes conveying line, and a second additional outlet section, that can be arranged aligned or at 90 degrees with respect to said outlet line, to make the boxes leave in alignment or at right angle to the longitudinal extension of the machine.

BRIEF DESCRIPTION OF THE DRAWINGS

The characteristic features of the invention, not resulting obvious from what has been said above, will be described in the following, with reference to the enclosed drawings, in which.

Figure 1A:
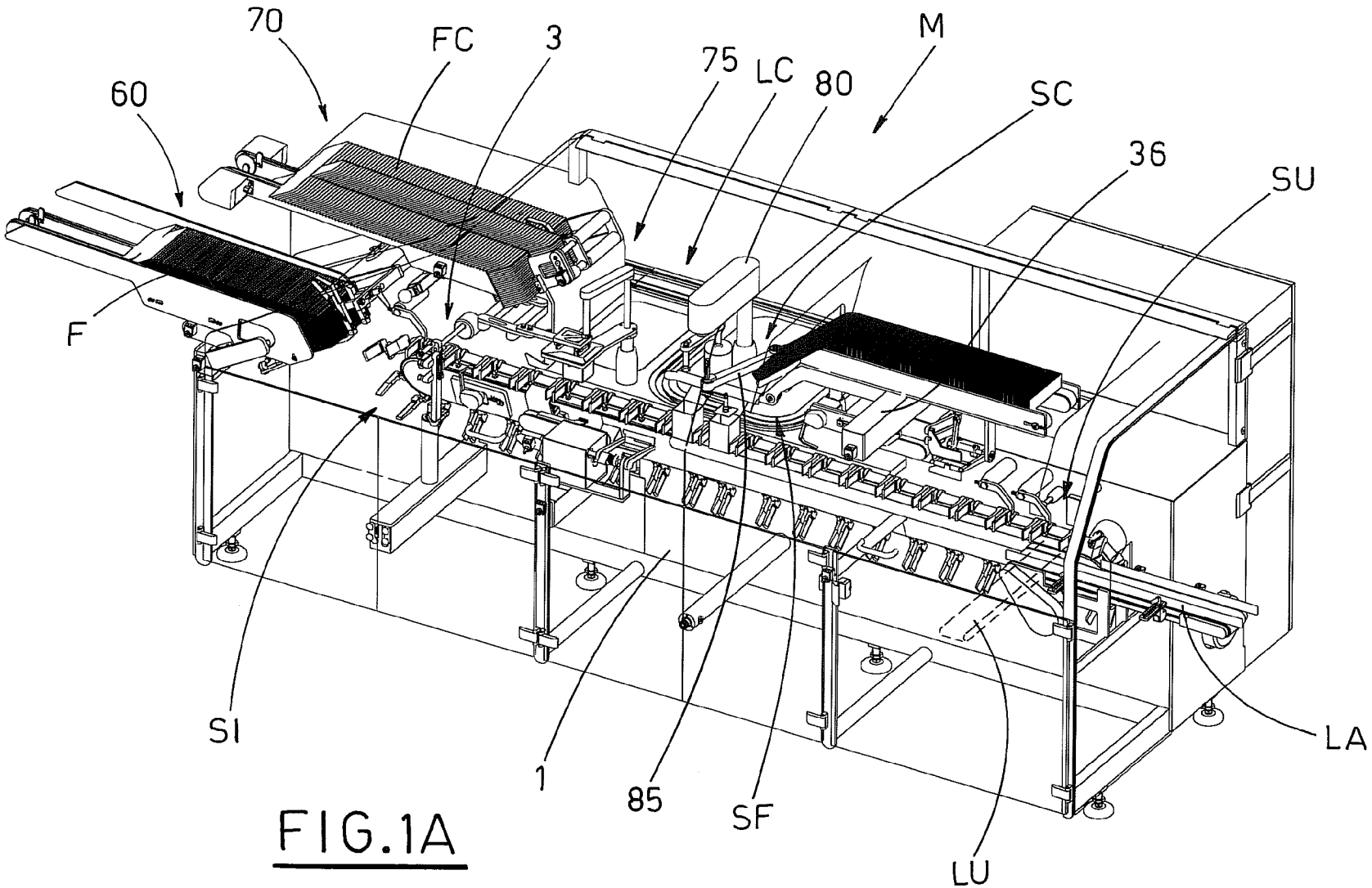
FIG. 1A is a perspective view of the machine in the whole.

Figures from 19A to 19R show different arrangements of the machine, according to the configuration adopted for the inlet and outlet of the articles and their containers.

DISCLOSURE OF THE PREFERRED EMBODIMENT

The machine M is commonly called "vertical", with this term actually referring to the direction, in which the articles are placed in the boxes.

This constructive configuration of the machine is used preferably, when the articles to be packaged have such a shape that allows them being stable only in vertical position, which is a frequent need in the perfumery and cosmetics field, in general.

From here derives the necessity of withdrawing the articles arranged vertical on the feeding line, possibly placed inside the in-the-art-called godet (recessed supports that match internally with the shape of the lower part of the containers and externally have a shape which can be easily manipulated).

The reference numeral 1 indicates the conveying line, mounted on the machine and aimed at transporting the boxes, for example of the type described in the Italian Patent Application BO2006A 000739 filed by the same Applicant. Therefore, the description of the conveying line will not be particularly detailed.

A magazine 60 for containing the flat folded tubular blanks F is situated upstream of the conveying line 1.

The blanks are placed in the magazine 60 side by side and lying on one of their folded edges, that is with the lateral flaps and the closing wings turned toward the opposite sides of the magazine.

An inlet station SI, in which the blanks F are withdrawn from the magazine by a withdrawing device 3, is situated near the magazine of blanks and near the initial part of the conveying line 1.

The picking up device 3 is for example like the one described in the Italian Patent Application No. BO2006A000123, filed by the same Applicant, thus described only briefly in the following.

Figure 6:
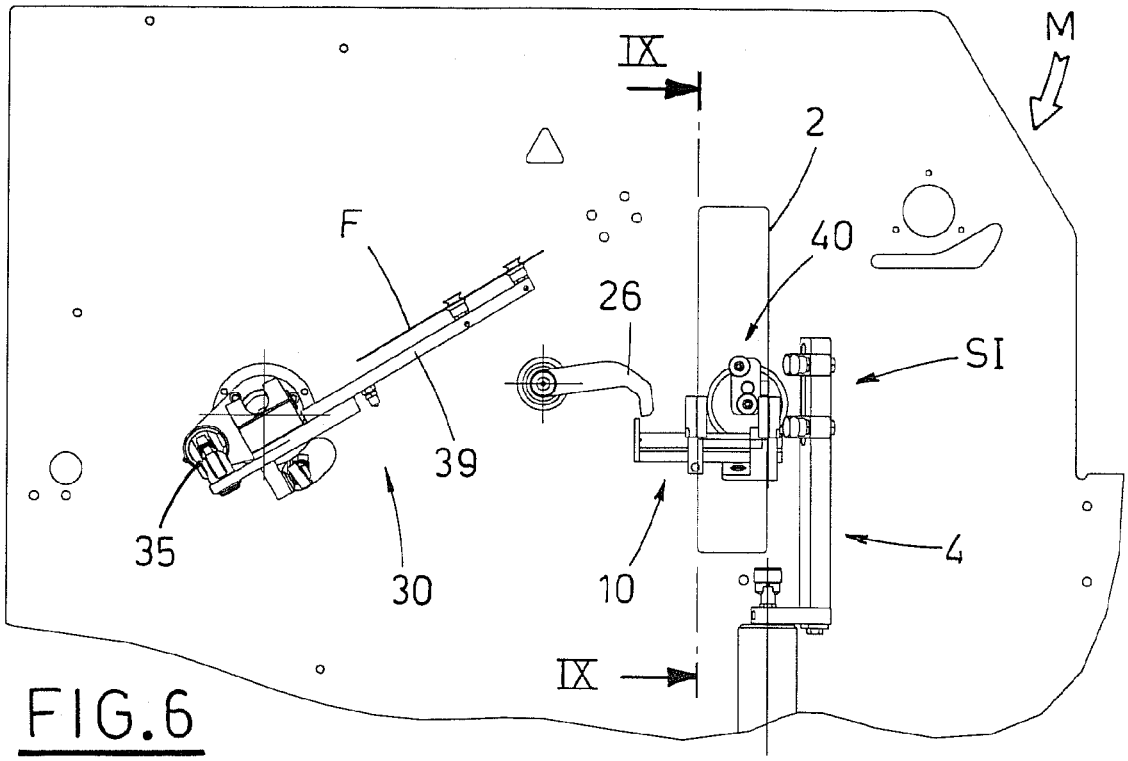
FIG. 6 shows a portion of the proposed boxing machine, related to withdrawing and opening of a blank.
Figure 7:
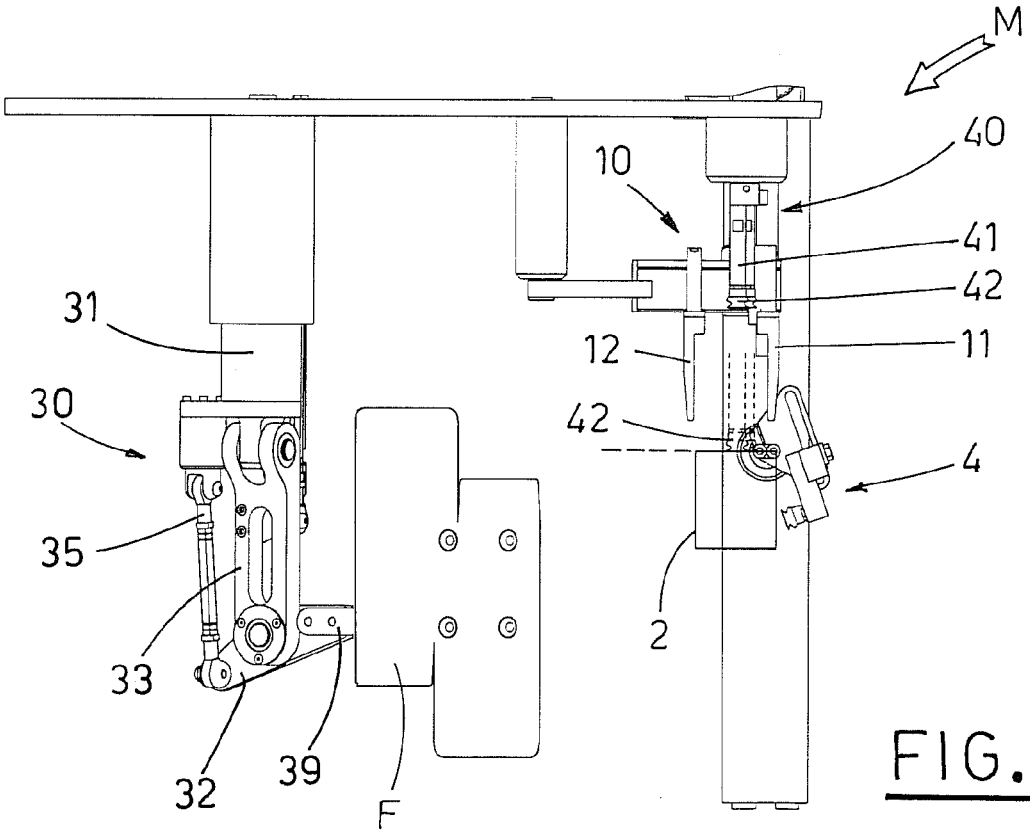
FIG. 7 is a plan view of FIG. 6.
Figure 8:
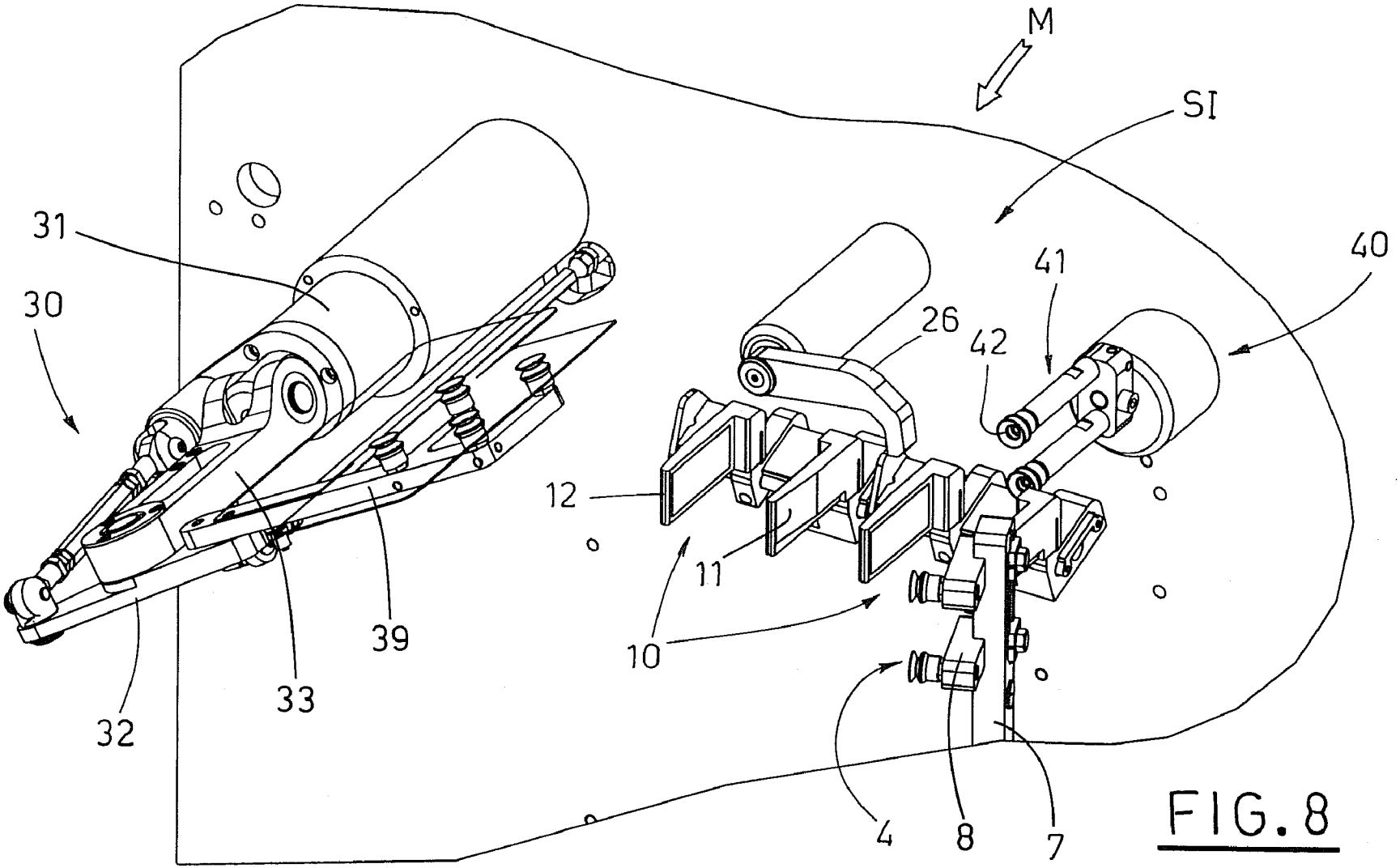
FIG. 8 is a perspective view of the view of FIG. 6.

The picking up device 3, better shown in FIGS. 6, 7, and 8, includes a roto-translating arm 30, that picks up one blank at a time from the magazine 60, keeping it horizontal, and then turns it to a vertical position, that is with the lateral flaps and the closing wings turned upwards and downwards.

The roto-translating arm includes a horizontal shaft 31, associated to actuating means (not shown), that make the shaft rotate, and an oscillating arm 33, hinge-coupled to the end of the horizontal arm.

The oscillating arm 33 is operated by an actuator that moves it from a position, in which it is aligned with the shaft 31, so as to ideally extending it along the longitudinal axis, and a position, in which the arm is inclined by 90° with respect to the shaft.

A plate 32 is hinge-coupled to the oscillating arm and fastened, with one end, to arrangement correcting means, that determine its oscillation on a surface parallel to the oscillating arm extension. The other end of the plate 32 carries a gripping arm 39, to which suction cups are fastened, actuated by suction means (not shown), to hold a wall of a blank F.

The arrangement correcting means include a linear actuator, for example a pneumatic jack, and a stem for joining the jack with the plate.

The erecting means 4, also situated in the inlet station SI, likewise provided with suction cups, receive the blank and erect it, obtaining each time a box 2. In particular, the erecting means include two metallic bars 8, carried by a vertical shaft 7 in a suitable position to cooperate with the roto-translating arm 30, so as to erect the blank and obtain the box 2.

The loading means 40, likewise situated in the inlet station, receive the boxes 2, already formed by the erecting means, and introduce them into the seats of the conveying line 1. The loading means 40 are formed for example, by a head 41, provided with suction cups 42 and moving according to a horizontal direction Y1, perpendicular with respect to the forward movement direction W, between a forward position (shown with broken line in FIG. 7), so as to withdraw the box, and a rear position, so as to the introduce the box into the corresponding seat of the conveying line.

For this purpose, as described in the above mentioned Italian Patent Application BO2006A 000739, the conveying line 1 includes a series of holding modules 10, associated to a motion group 20 aimed at determining forward movement of the modules along a loop path P, including an upper active run RA and a lower backward run RR.

The terminal part of the active run RA is situated in correspondence to a discharge station SS, from which originates an outlet line LU, along which the completed boxes leave the machine.

In particular, the motion group is formed by a belt 21, which has fastened thereto the holding modules 10 and which is operated with the active run RA moving in the forward movement direction W. The belt is mounted on pulleys 22, only one of which is visible in the figures.

The holding modules 10, as provided in the above mentioned Italian Patent Application BO2006A 000739, include each one a fore prong 11 and a rear prong 12, that lie against the front wall 2A and the back wall 2B of the box, respectively, with respect to the forward movement direction W. The previously mentioned receiving seats are defined each one between a pair of prongs.

The prongs are provided with coatings 11R and 12R made of soft material having high friction coefficient, such as for example silicone rubber, so to limit the risk of scratching the walls 2A and 2B, stabilizing as much as possible the box gripping.

According to a preferred embodiment and a characteristic aspect of the invention, the rotation axis A of the pulley 22, as well as the rotation axis of the opposite pulley, not shown, is inclined with respect to the horizontal, so that the upper active run RA is staggered with respect to the backward run RR, and precisely, moved more toward the front part of the machine M.

The prongs 11 and 12 are inclined with respect to the belt 21, so as to compensate for the inclination of the pulleys and the belt, maintaining their extension in horizontal.

Figure 9:
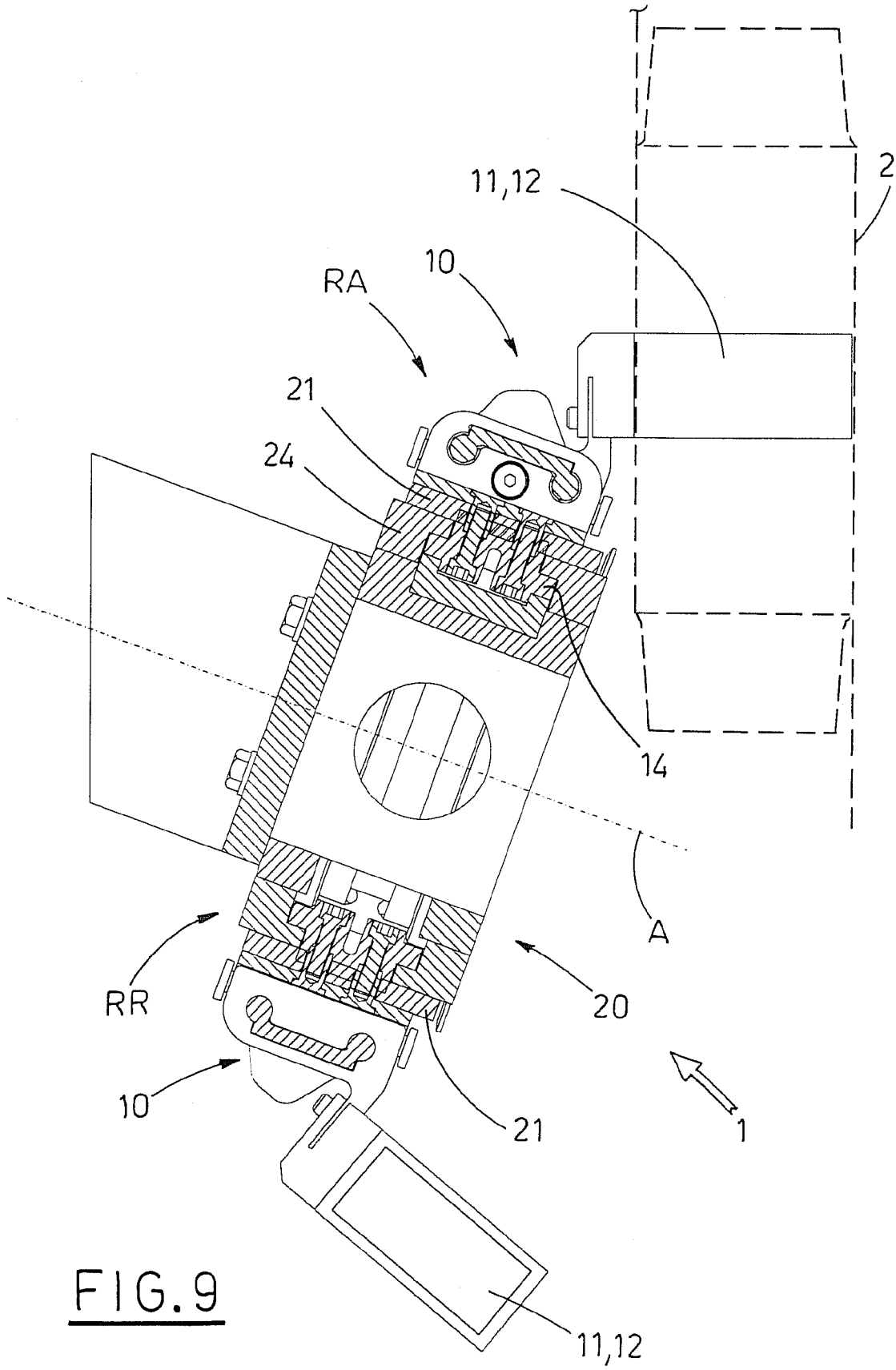
FIG. 9 is a vertical section view of the gripping system.

This particular configuration has the advantage deriving from the fact that below the boxes, kept perfectly in vertical position by the inclined prongs, there is a free space, available for housing and moving the mechanisms (not shown) aimed at closing the lower heads of the boxes 2 (see in particular FIG. 9).

This allows also to lower the belt 21, making it more easily accessible, and, on the whole, to reduce the machine dimension in height, making it possible to lower also the magazines position, thus making also the magazines more easily accessible. This is possible due to the fact that the loop path covered by the belt can be reduced in height, since the backward run RR does not constitute an obstacle. On the other hand, if the pulleys and the belt were held in vertical, the backward run should extend below the heads closing means, increasing the loop and, consequently, shifting the whole assembly upwards.

Another characteristic of the holding modules 10 lies in the fact that the rear prong 12 is subjected to the elastic tightening means 16, aimed at maintaining the module in closing position C, with the prongs 11 and 12 spaced apart according to the width of the box 2 to be conveyed. The elastic tightening means include a carriage 160, sliding in a seat 130, made in a block 13, clamped to the belt 21 and carrying, at its ends, two plates 161 and 162, whose task is to limit the carriage 160 excursion.

A spring 163 pushes the carriage with a stop 164 abutting against the front wall 13A of the block 13, delimiting the carriage stroke, which is corresponded by the moving of the rear prong 12 away from the fore prong 11.

The carriage is associated to the adjustment means 120, for the variation of the distance between the prongs 11 and 12, between a minimum value H1 and a maximum value H2, according to the boxes 2 dimension.

The adjustment means 120 include a slide 121, gliding on the carriage 160, which can be locked by the elastic means 123, to fasten the slide on the carriage, according to the box size. The rear prong 12 is fastened to the slide.

First opening means 26 are situated in the inlet station SI, outside with respect to the holding modules 10 and the motion group 20, to act on the elastic tightening means 16, to make the rear prong 12 move away from the fore prong 11, within the limit allowed by the possible motion for the carriage 160.

The first opening means 26 include for example an oscillating pawl, aimed at blocking the rear plate 162 directly before stopping of the related holding module 10 in the inlet station.

The box introduction action by the loading means 40 occurs during the stop of the module 10 with the prongs 11 and 12 in open position.

A station for withdrawing and placing of a sheet of ribbed material FC from a related magazine 70, provided optionally, is situated, likewise optionally, along the path of the active run RA of the conveying line. The sheet of ribbed material is suitably shaped, so as to obtain a support or a protection for the article, that is to be introduced into the box 2. Consequently, also the shaped sheet of ribbed material is introduced into the box by suitable means 75, here not described and not shown in detail, but only schematically, since not relevant for the invention.

After the station for placing the sheet of ribbed material, there is a station for placing the articles SC, where terminates a feeding line LC of the articles to be packaged.

The description will not refer in detail to the means 80 for picking up the articles from the feeding line, aimed at placing the articles in the boxes, since they are of known type, for example of pick-and-place type, and are not relevant for the description of the invention.

As far as the feeding line of the articles LC is concerned, it is important to notice that it includes a section 78, extending longitudinally along the side of the packaging machine, up to its head more upstream.

This technical solution is described and claimed in a more detailed way in a corresponding patent application filed by the same applicant on the same day of the filing of the present application. Therefore, this specification will not describe more widely also this characteristic.

Figure 1B:
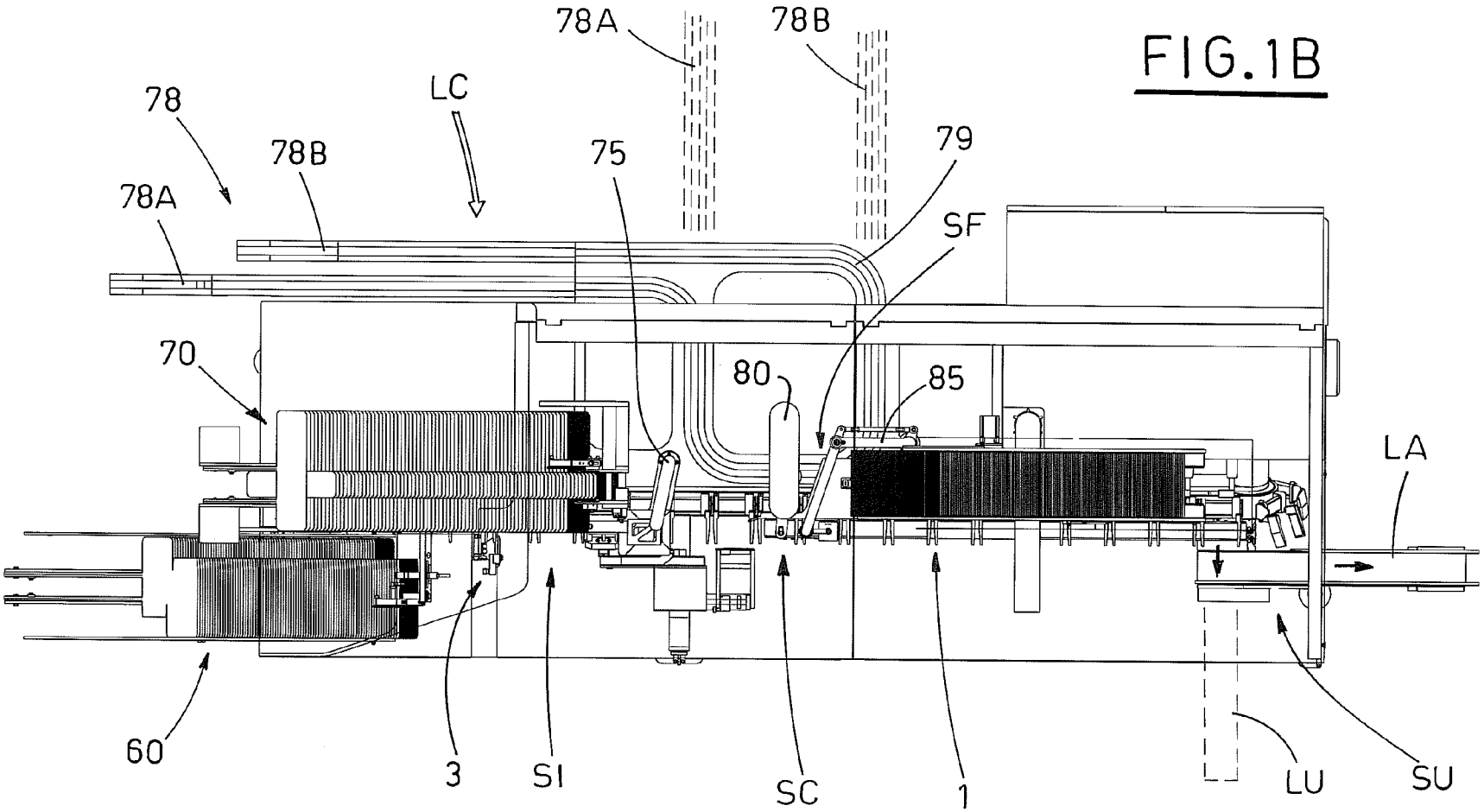
FIG. 1B is a plan view of the machine.
Figure 1C:
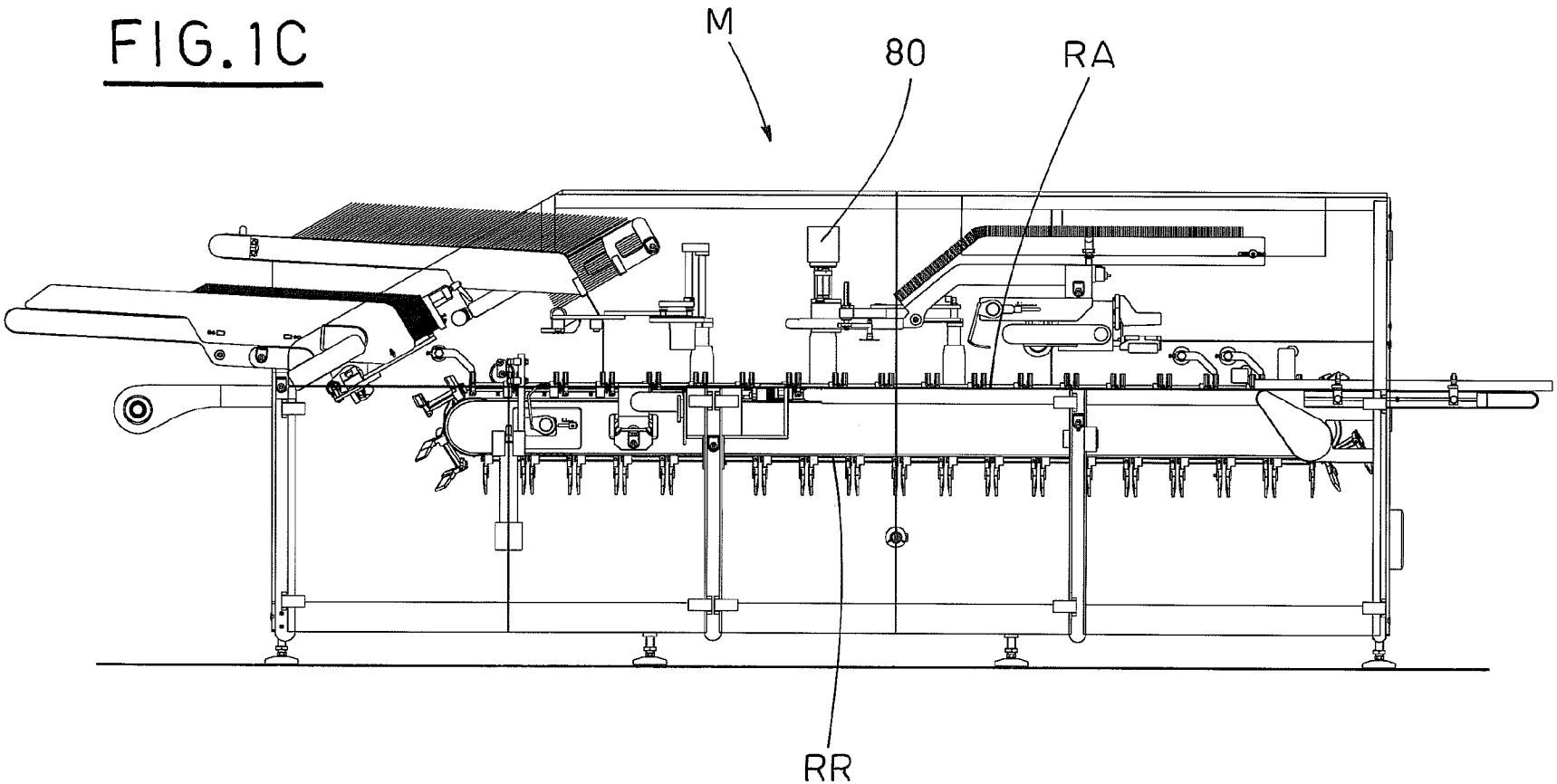
FIG. 1C is a lateral view of the machine.
Figure 1D:
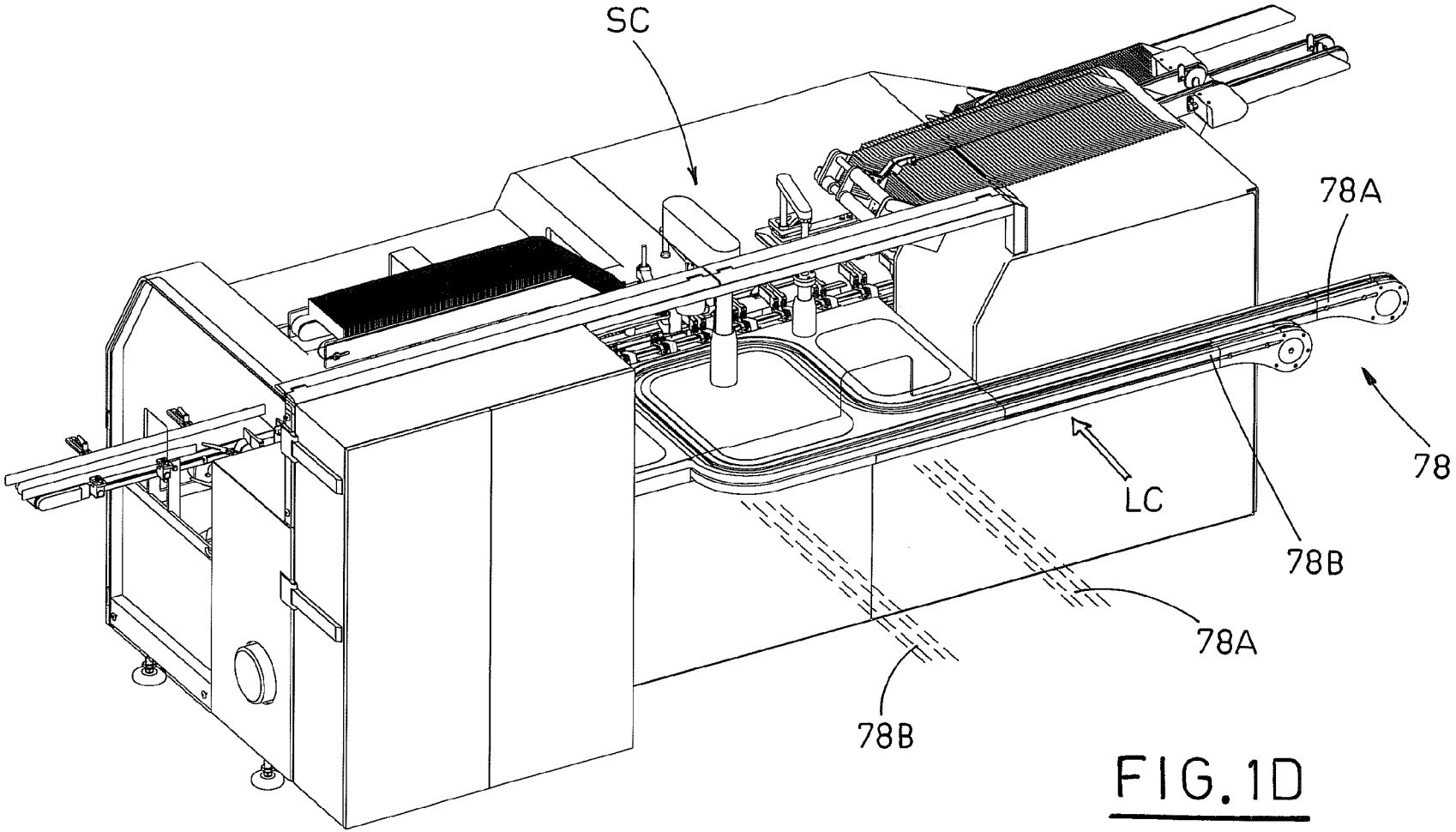
FIG. 1D is a perspective rear view of the machine.
Figure 3:
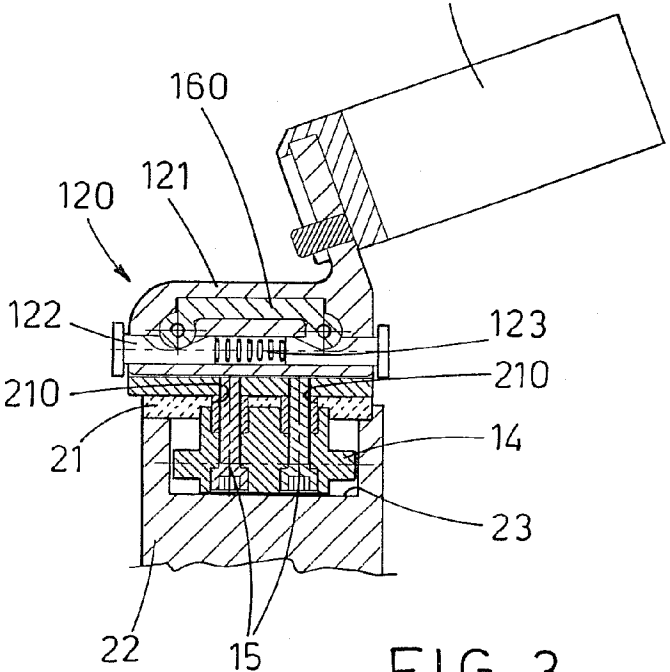
FIG. 3 is a section view taken along the line III-III of FIG. 2.
Figure 2:
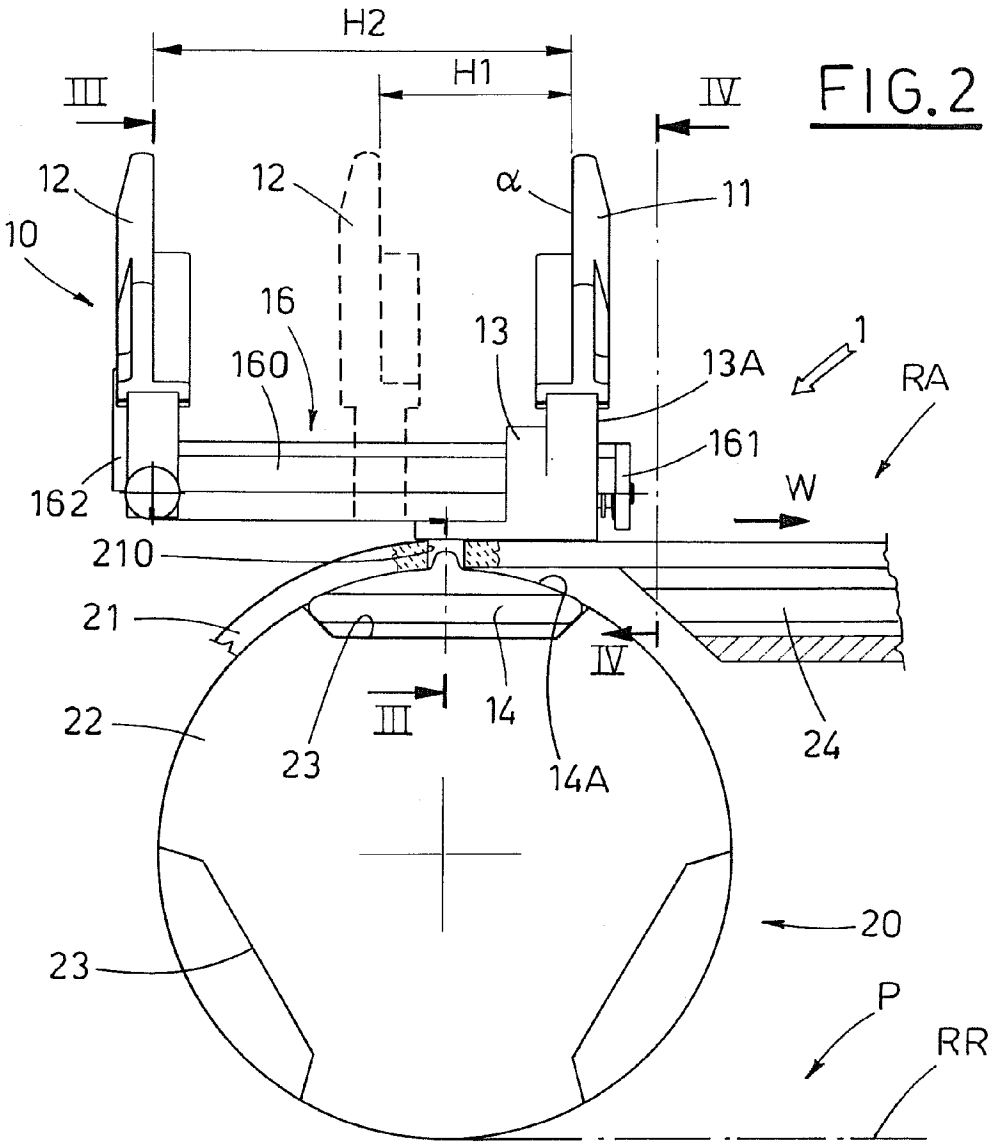
FIG. 2 is a lateral, partial view of the withdrawing system.
Figure 2A:
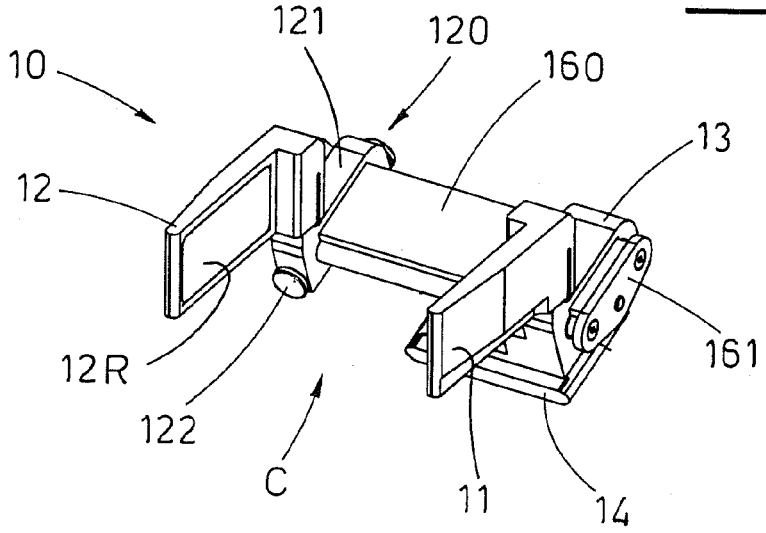
FIG. 2A is a perspective view of a holding module of the transferring line.
Figure 2B:
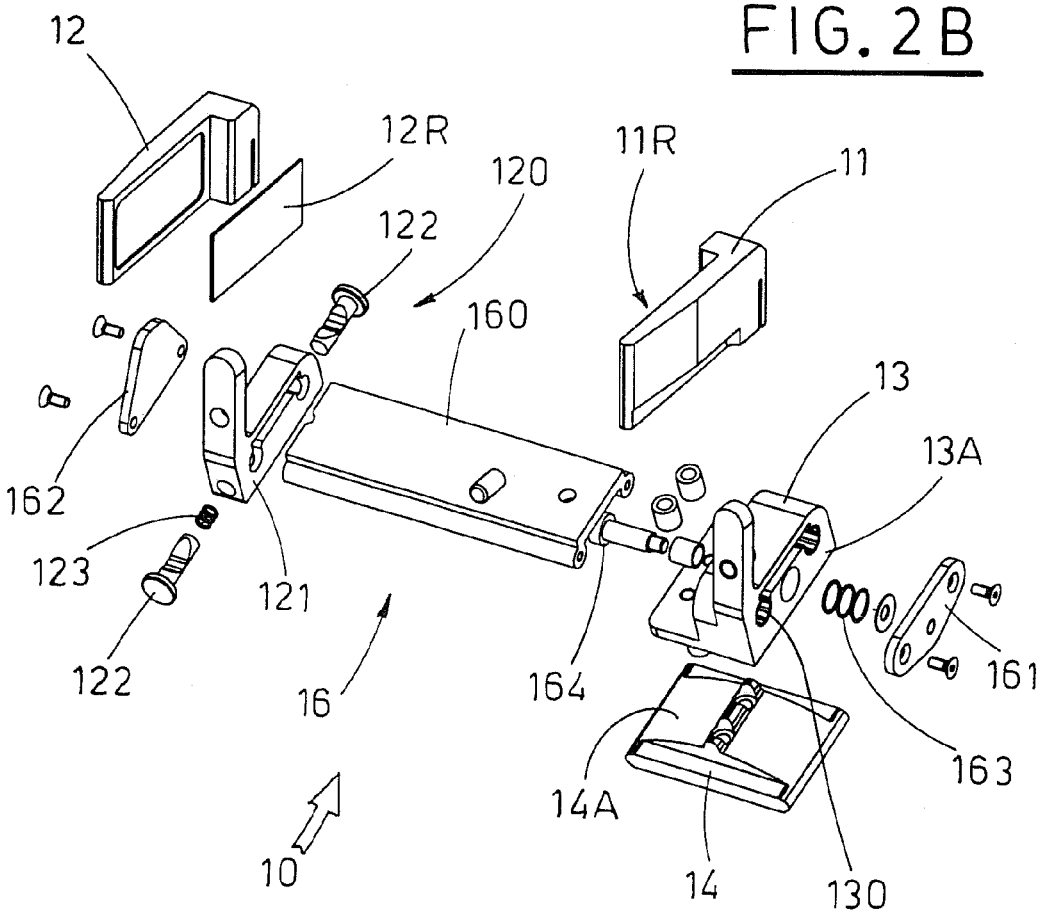
FIG. 2B is an exploded perspective view of the module of FIG. 1A.
Figure 4:
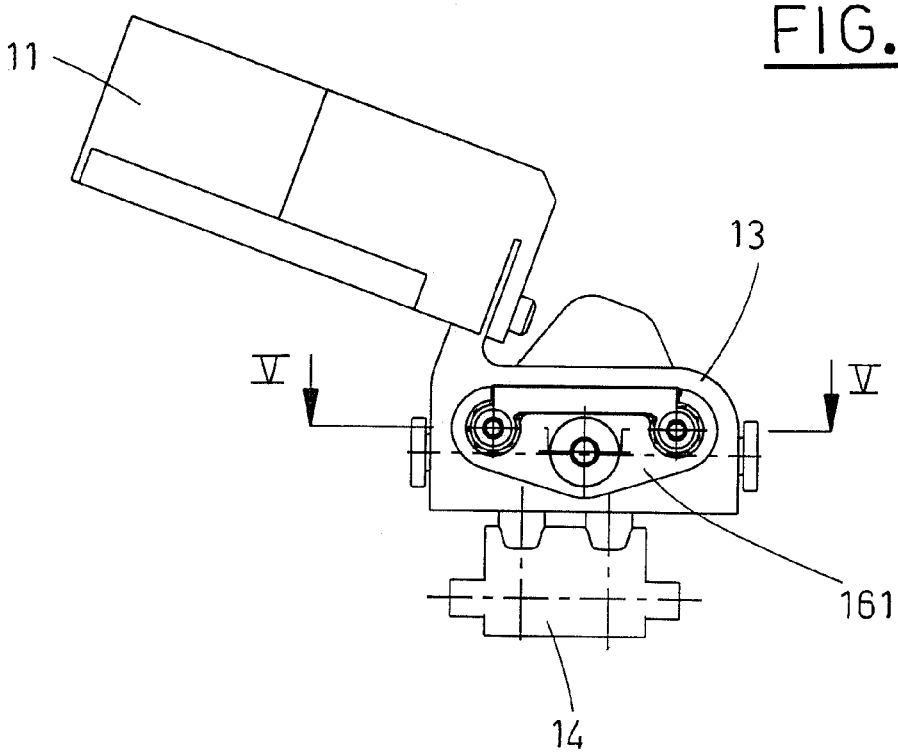
FIG. 4 is a section view taken along the line IV-IV of FIG. 2.
Figure 5:
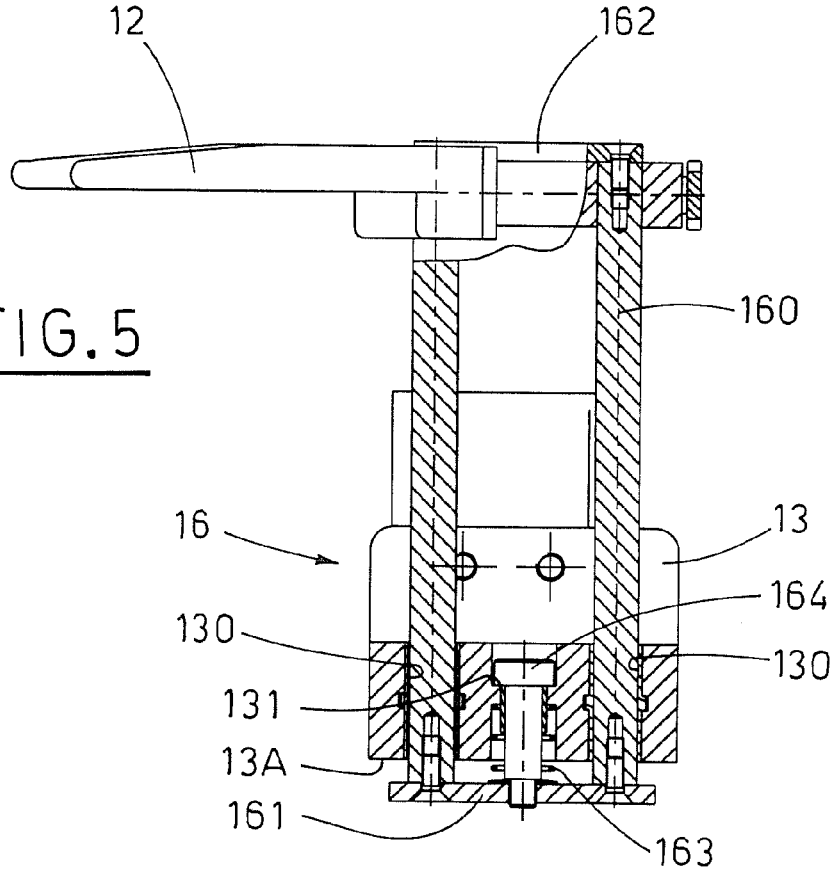
FIG. 5 is a section view taken along the line V-V of FIG. 4.

As it is seen in FIGS. 1B and 1D, the section 78 is formed by two runs 78A and 78B, that can be oriented horizontal, joined together or separated, during the machine construction.

The terminal part of the feeding line LC extends horizontally, like a ring 79, thus allowing the return of possible not picked up articles, that are subsequently collected by known systems, or of godets, emptied of the respective article by the pick-and-place means, in case such supports are used, and then brought back to the production line.

Apart from the example shown in the figures, the orientation of one or two runs 78A and 78B is determined according to the specific collocation that the machine will have to assume with respect to the production line in general, that is with respect to a production unit, situated upstream, and a working unit, for example for packaging, situated downstream.

For example, the second run 78B of the feeding line LC can be even omitted in the case, in which the treated articles are not arranged on the godets, since in this case the re-circulation of the supports is not necessary.

The combination given by the presence or absence of the backward run 78B and/or by different orientations assumed by the two runs 78A and 78B leads to different configurations, shown schematically in Figures from 19A to 19R.

Figure 19E:
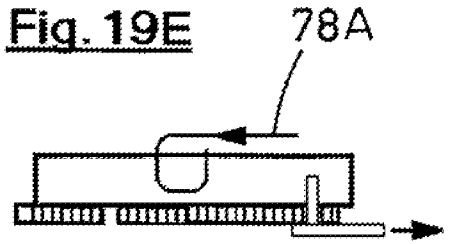
Figure 19F:
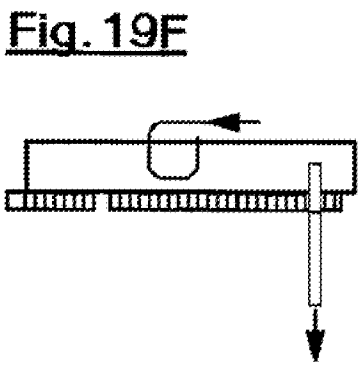
Figure 19C:
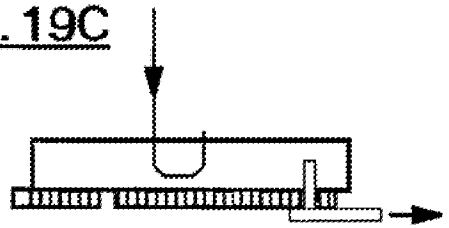
Figure 19D:
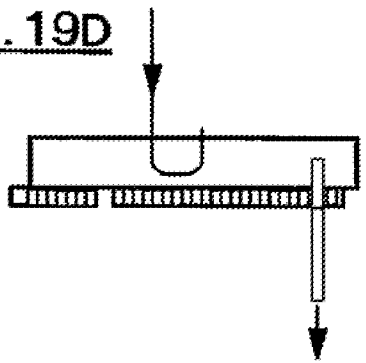
Figure 19A:
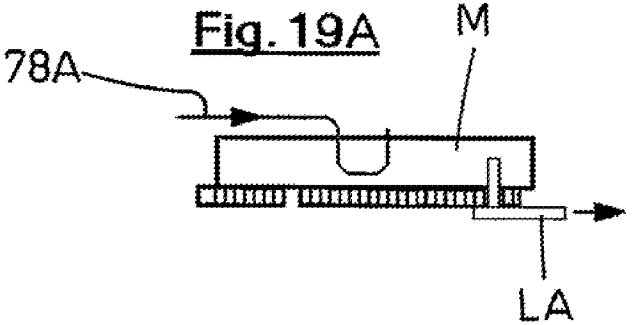
Figure 19B:
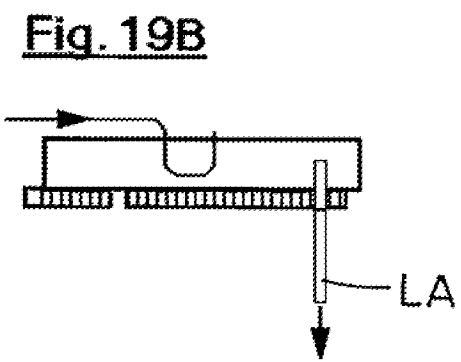
Figures 19G, 19H, 19I, 19J, 19K, 19L:
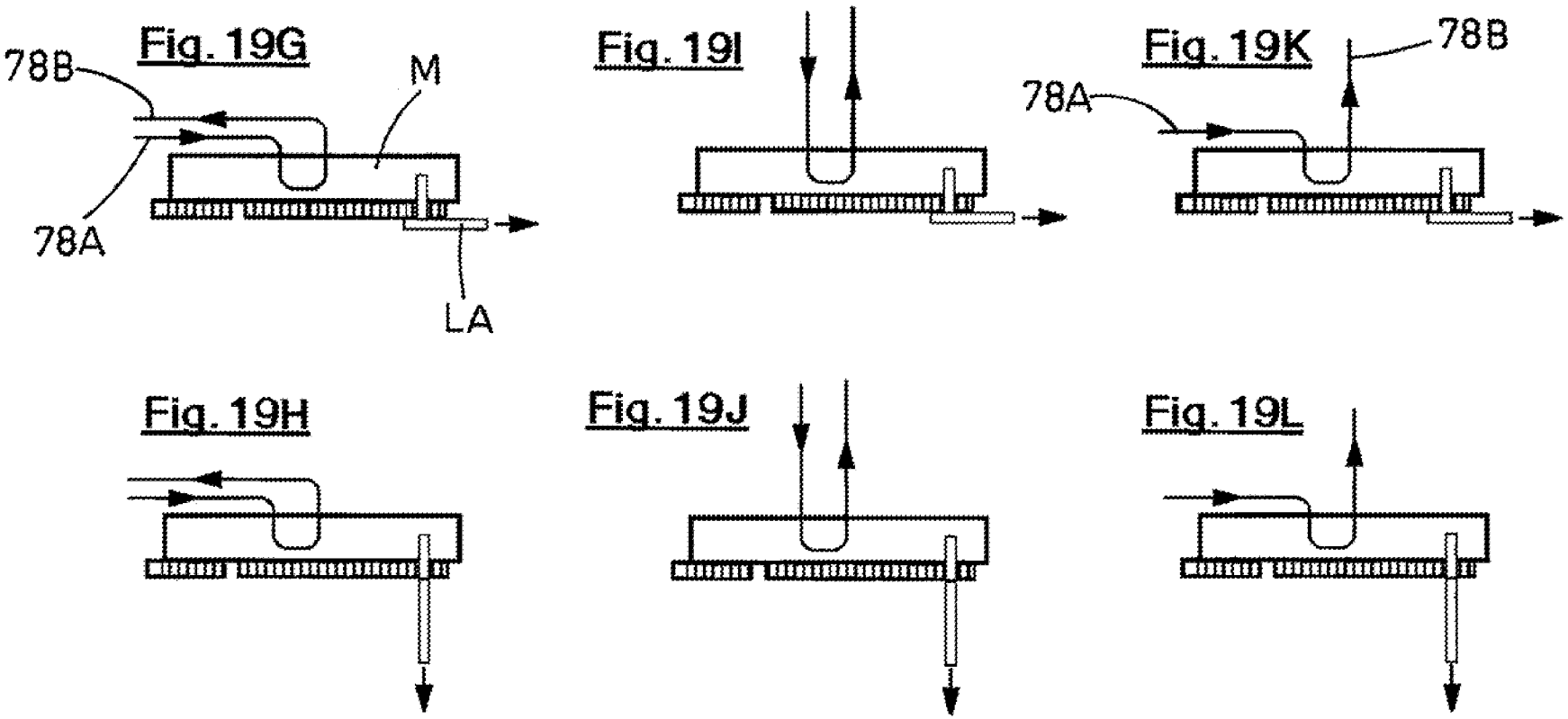
Figures 19M, 19N, 19O, 19P, 19Q, 19R:
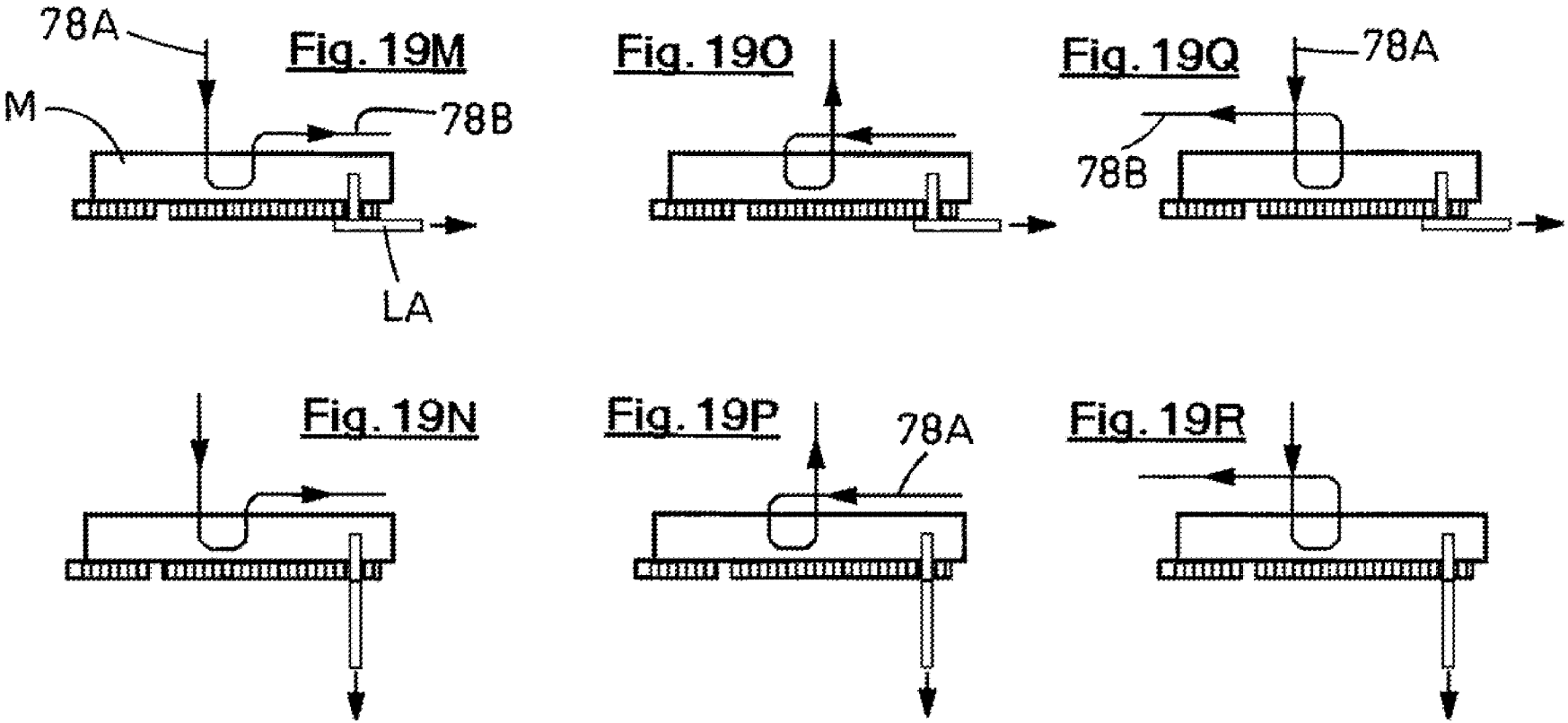

In the case shown in FIG. 1A, which corresponds to the schematic representation of FIG. 19H, the articles feeding line LC presents to the machine head aligned with its longitudinal extension, allowing the coupling with a unit that supplies the articles, likewise aligned with the machine.

FIGS. 1B and 1D show schematically a transversal orientation of the runs 78A and 78B of the access section 78, as schematically depicted by FIGS. 19 I and 19 J, that allows the coupling with a production unit, arranged at 90° with respect to the machine.

With reference to the schematic representations of the machine M, in FIGS. 19A and 19B the machine is supplied with the run 78A of the line LC, arranged longitudinally to the machine side and respectively with the delivery of the already filled boxes occurring in line or at right angle.

The arrows indicate the movement direction of the articles and the moving away direction of the filled boxes. In this case, the backward run 78B of the line LC is not provided, as not used.

In FIG. 19A, the machine M is oriented in alignment with the production unit, situated upstream, as well as with the working unit, situated downstream (both not shown). In FIG. 19B the machine is aligned with the production unit situated upstream and is perpendicular to the direction in which the boxes are sent to the working unit, situated downstream.

In the case of FIGS. 19C and 19D, the articles are supplied in a direction perpendicular to the machine M.

In the case of FIG. 19C, the machine is oriented perpendicular to the production unit, situated upstream, and aligned with the working unit situated downstream.

In FIGS. 19E and 19F the origin of the articles supplied to the machine is changed.

In FIGS. 19G, 19H, 19I and 19J also the backward run 78B of the feeding line LC is added, for example because the godets are used for conveying the articles and the configurations of the previous figures are reproduced.

Finally, in *Figs*. from 19K to 19R the previous combinations are proposed again, but with the runs 78A and 78B oriented in different directions.

After the station for placing articles SC, there is a station for placing informative leaflets SF. The important aspect of the station for placing the informative leaflets concerns its possibility to be adapted rapidly to the leaflets conventional arrangements (not shown here, so as to clear better the machine constructive configuration).

In the first arrangement, a moving articulated arm 85 performs, on a horizontal plane, an angular movement that extends from a magazine containing the leaflets and situated beside, with respect to the conveying line 1 (not shown here, so as to better show the machine configuration), up to an area situated below the means for placing the articles 80. In this way, the articulated arm 85 picks up each time one leaflet and puts it under the article that is to be introduced into the dwelling box 2.

Then, the article drags the leaflet during its introduction into the box, in known way.

In the second working configuration, the articulated arm 85 performs a more limited angular movement, and stops downstream of the means for placing the articles 80, that is at a point, in which the boxes pass, after the articles have been introduced therein. In this case, the leaflet is situated above the article, again in known way.

The arrangement of the arm in one or another of the two working configurations is rapid and simple, thus allowing a considerable reduction of time necessary for adapting the machine to different sizes and types of boxes and articles.

In particular, it is not necessary to substitute any part of the device.

There are additional closing means for closing the supports of ribbed material before closing the boxes, likewise arranged or activated optionally, if the supports of ribbed material have been introduced and if they must be closed.

Afterwards, along the feeding line 1, there is a device for the application of a stamping on a part of the box bottom, in particular the closing flap, which is still open and turned downwards. These means are not shown, as of known type and not relevant for the invention purposes.

Before reaching the discharge station SS, below and above the active run RA of the conveying line 1, there are closing means 36, which close the lower and upper wings of the box 2, that have remained open up to this moment, while the blank has moved, sliding on the lower lateral flaps, closed and lying on a conveying belt 141, situated below the active run RA of the conveying line 1.

The conveying belt 141 is operated by link to the same operation means of the conveying line 1, so that it can move with the same forward movement speed as the line 1.

Figure 16:
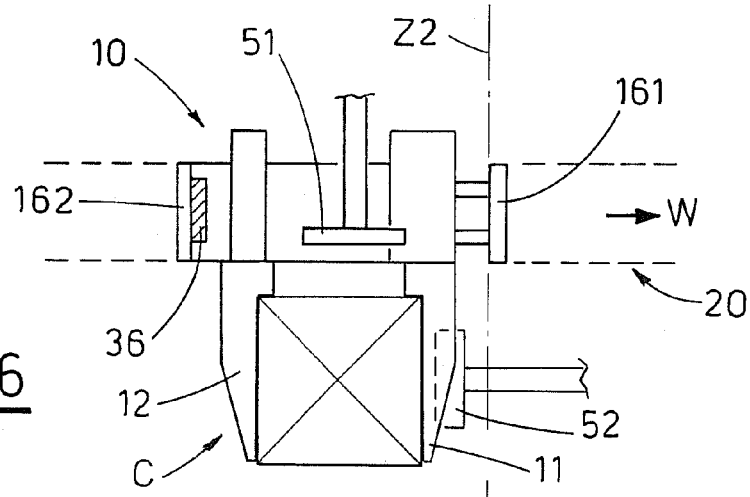
FIGS. 16, 17, 18 show subsequent steps of the discharging of the box by the holding module.
Figure 17:
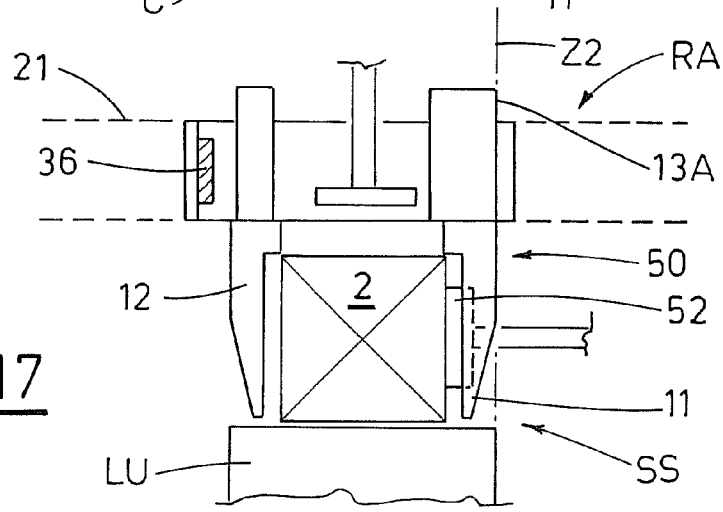
Figure 18:
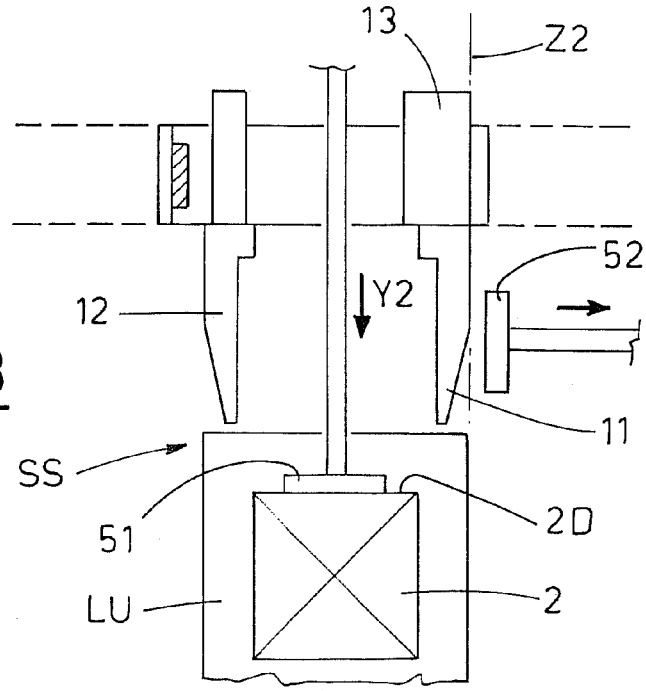

In the discharge station SS there are second opening means 36, practically identical with the first opening means 26 (seen only partially in FIGS. 16, 17 and 18). In the same area there are also extracting means 50 for extracting the boxes 2 from the holding modules 10, during their dwell with the prongs 11 and 12 open. The action of the extracting means 50 takes place in the horizontal extraction direction Y2, that is in a direction perpendicular to the forward movement direction W, moving the boxes on the outlet line LU.

The extracting means 50 include a pusher 51, operated in a transversal extraction direction Y2 and helped by a moving abutment 52, that is operated in the forward movement direction W, so as to lie against the front wall 2A of the box 2.

Besides the outlet line LU, there is also an additional line LA, which can be arranged aligned or at right angle with respect to the outlet line LU. This allows the filled boxes to leave in alignment or at right angle with respect to the longitudinal extension of the machine M.

Now, operation of the machine will be described, keeping in consideration the fact that the obtained advantages depend on its constructive configuration and on its arrangement rather than on its functional characteristics.

Figure 10:
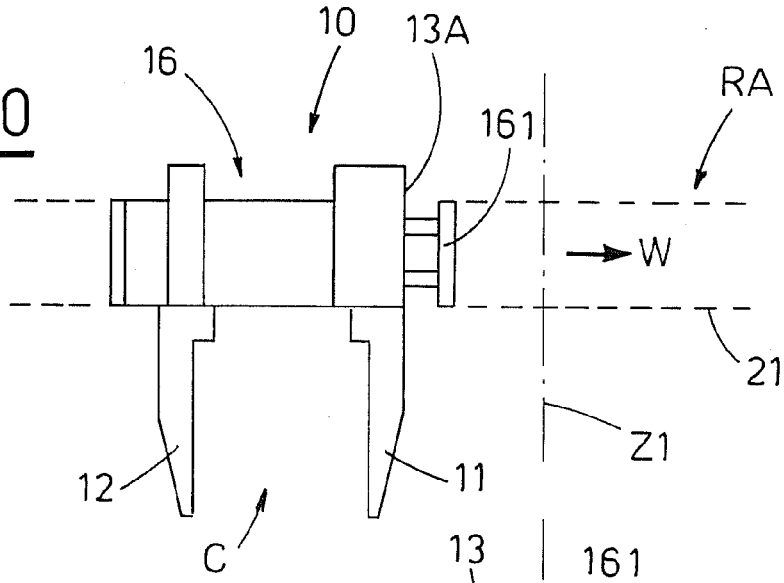
FIGS. 10, 11, 12, 13 show subsequent steps of the introduction of a box in a holing module of the transferring line.
Figure 11:
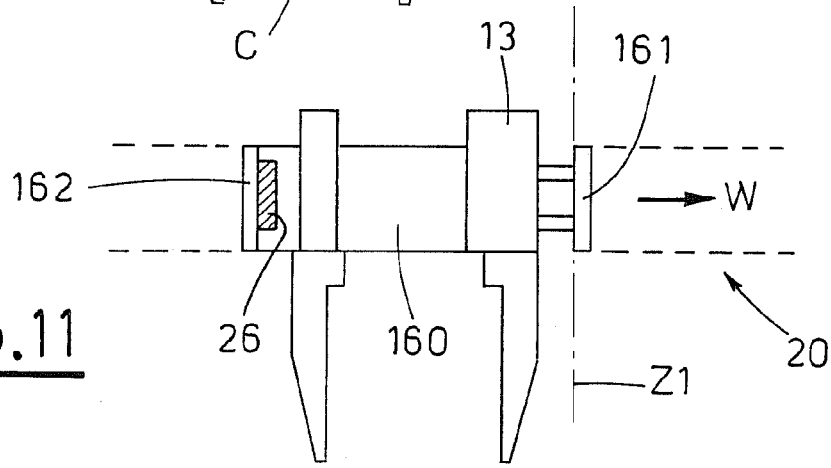

FIG. 10 shows a holding module 10, reaching the closing position C in the inlet station SI, while in FIG. 11 the fore plate 161 has gone beyond the reference line Z1. At this point, the oscillating pawl 26 is lowered (seen only partially), so as to stop the rear plate 162, stopping also the carriage 160 with the rear prong 12, while the fore prong 11, integral with the block 13 goes on, bringing the holding module to the opening position, in which the distance between the prongs is bigger than the box dimension.

The fixed reference of the holding module, arranged in fore position, goes beyond the fixed reference defined by the front wall 2A of the box kept by the erecting means 4.

Figure 12:
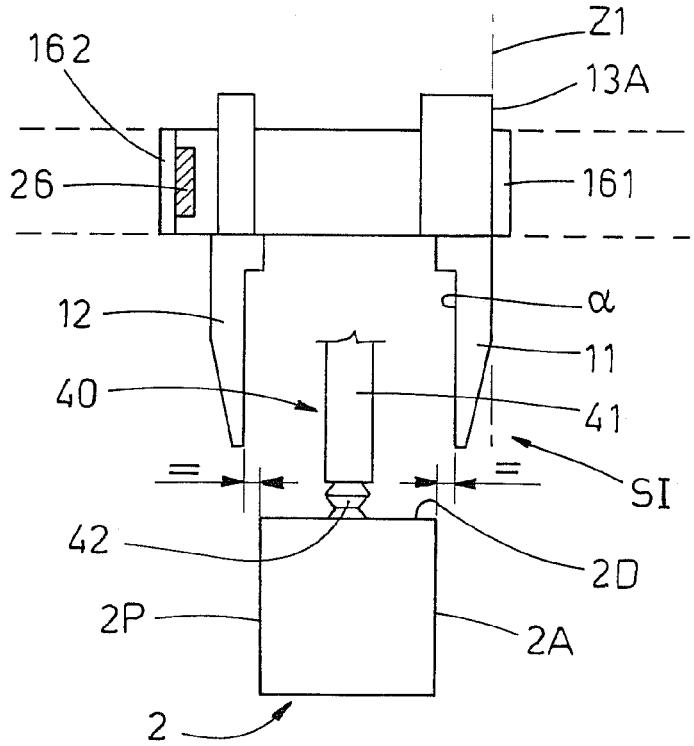

The box is delivered to the loading means, with the head 41 in the forward position, in which the suction cups grip the longitudinal wall 2D of the box (FIG. 12).

Figure 13:
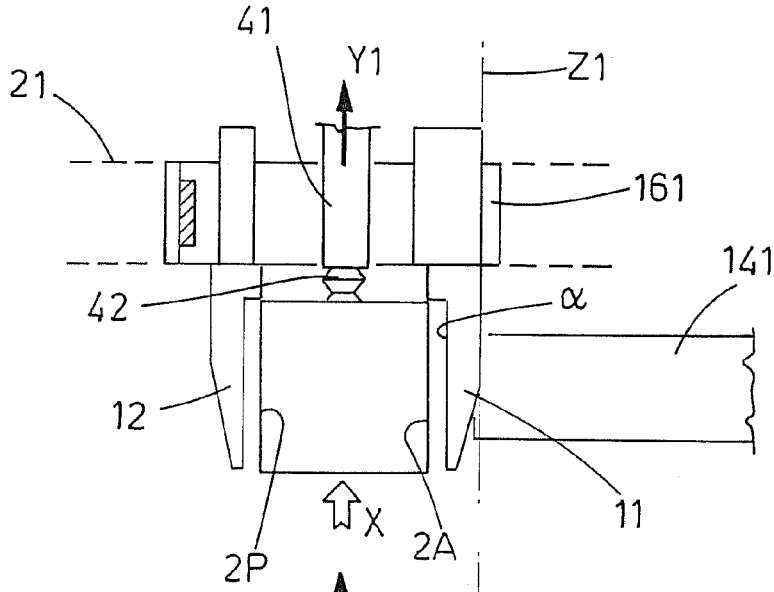

When the head is brought back to the backward position, the box is inserted between the widened prongs 11 and 12, however without touching them. In this way, scratches are certainly avoided (FIG. 13).

Figure 14:
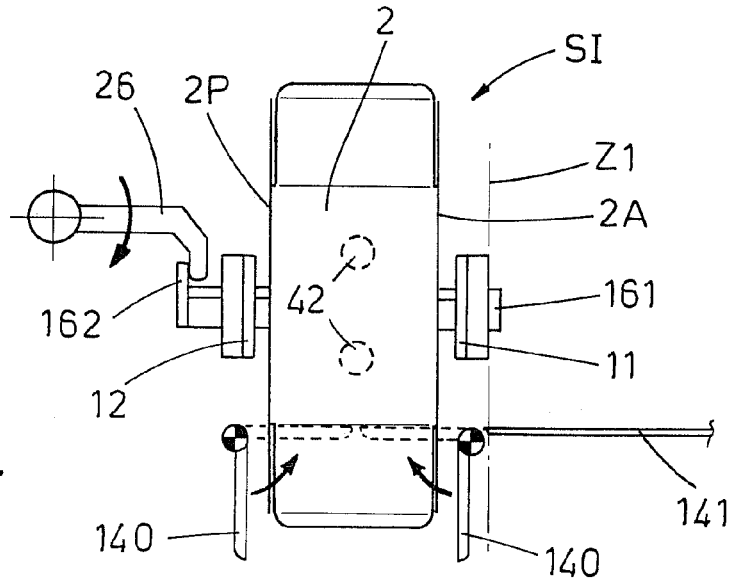
FIG. 14 is a front view of the same step of FIG. 13.

Before the head 41 goes backward completely, leaving the box, the folding means 140, situated in the inlet station SI below the box 2, are operated to fold the box lower transversal flaps, that lie on the conveying belt 141, extending parallel below the active run RA (FIG. 14).

This operation allows the box to be supported from below in time included between the box release by the suction cups 42 and the box gripping between the prongs 11 and 12. In particular, the box is placed lying on the conveying belt 141, that supports it along the whole path of the conveying line 1, keeping closed the bottom and the lower lateral flaps.

As already said, the folding means 140 can operate freely on the box lower part, since the backward run RR of the conveying line 1 does not interfere therewith.

Figure 15:
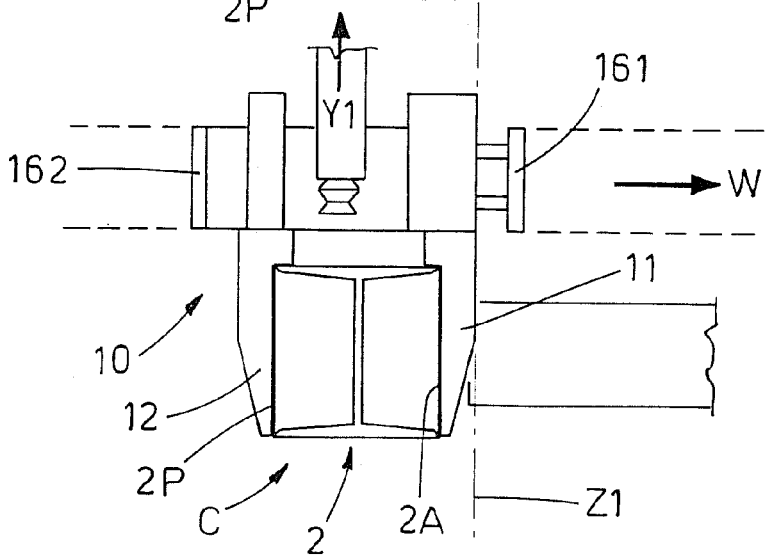
FIG. 15 shows the step, in which the box is disengaged from the holding module.

In FIG. 15 the head 41 is in its rest position, while the oscillating pawl 26 has released the rear plate 162, allowing the spring 163 to bring the carriage 160 back to the initial position, closing the two prongs.

With stepwise movements, the box 2 is then made pass through the subsequent working stations of the machine M, arranged along the upper active run RA of the conveying line 20.

During this passage, the box lower part, in particular the closed lower lateral flaps, move lying on the plane constituted by the conveying belt 141.

The boxes pass through a region corresponding to the means for withdrawing and placing the sheets of ribbed material, which are picked up, shaped and inserted into the boxes, when they are necessary for the articles correct support.

Subsequently, the boxes are made pass, always stepwise, below the means for withdrawing and placing the articles 80. Here, the articles are fed along the articles feeding line LC, freely arranged thereon or placed in the respective supports, also known as godets.

The article placing means, of the pick-and-place type, put the articles into the boxes, possibly above the informative leaflet, in the meantime placed by the related placing means 85. On the other hand, if the leaflet must be situated above the article, the latter is introduced directly into the box and the leaflet is placed afterwards.

Before the arrival to the discharge station SS, an identification code of the article is printed (if required) on the lower closing flap, and then the second closing means 35 close the heads of the box 2, practically completing the pack.

Before closing of the upper flaps and wing, the additional closing means (optional) close the supports of ribbed material.

Like in the case of the inlet station SI, also in the discharge station SS, as shown in FIG. 16, an oscillating pawl of the second opening means 36 act to block the rear plate, while the moving abutment 52 is situated in its work position, at a distance from the box front wall 2A equal to about half the distance between the fore plate 162 and the front wall 13A of the block 13.

Consequently, while the block 13 moves forward, the rear prong 12 remains locked, so that the two prongs open again. During this step, the box 2 continues its motion due to inertia, remaining lying on the conveying belt 141, until it strikes the moving abutment 52, that stops it.

In this step, it becomes evident how advantageous it is to have the reference corresponding to the box front wall, that allows to move the box 2 away from both the prongs by the moving abutment 52.

When the holding module 10 stops, the moving abutment 52 is moved and the pusher 51 is operated to push the box out of the seat, defined by the holding module 10, between the two prongs 11 and 12. The box is pushed on the outlet line LU oriented perpendicular with respect to the active run RA.

Therefore, the box goes out in a direction transversal to the machine longitudinal extension, so as to be transferred to the additional line LA and to reach another working unit, situated downstream, for further finishing operations or for being packed and then sent.

The additional line LA can be arranged, during the machine construction, in alignment with the outlet line LU, consequently at right angle with respect to the machine M, so as to transfer the boxes to another working unit, situated beside the machine M, perpendicular thereto.

On the other hand, if the additional outlet section LA is arranged at right angle with respect to the outlet line LU, it is possible to deliver the boxes to another machine or subsequent working unit in a longitudinal direction with respect to the machine extension.

This possibility to supply the articles at the outlet in longitudinal direction, as well as in the transversal direction, makes the machine uncommonly versatile, and makes it possible to couple it to other machines or working units with less positioning constraints.

The versatility and easiness of coupling with other machines or working units are further increased by the predisposition of the articles feeding line, that extends longitudinally or perpendicular to the machine rear side.

This allows to couple the packaging machine with other manufacturing machines or working units in line or at right angle.

The different combinations of the arrangements of the articles feeding line LC, and in particular of the two runs 78A and 78B forming it, allow to obtain different configurations of the machine and of its coupling with the working units upstream and downstream, according to the examples shown in *Figs*. from 19A to 19R.

The time for adapting the machine to the size change of the treated articles and boxes, is reduced also due to the bigger rapidity with which the means for placing informative leaflets are adapted, according to the arrangement required each time.

In all the above mentioned operations, the integrity of decorative treatments present on the box walls remains protected, due to the presence of the soft coatings 11R and 12R on the prongs, as well as to the absence of the friction movement on the box walls, including the transport of the boxes between the inlet station and the discharge one, in which the box moves on the plane of the conveying belt 141.

This characteristic makes the machine particularly suited to the fields, such as cosmetics and top of the line perfumery, whose products require a careful and delicate manipulation.

Another advantage of the constructive configuration has been obtained by the arrangement with inclined axis of the conveying line 20. This allows to reduce the spaces occupied in the vertical direction, lowering the machine and all its means, which consequently are easier to accede, thus improving the overall ergonomic characteristics of the machine.

The magazines of the blanks and the optional ones of the sheets of ribbed material are situated upstream of the conveying line, almost at the same level, also due to the use of the roto-translating arm, that allows this positioning, making them more accessible and reducing the machine height.

On the whole, all the working stations and the means provided therein are situated in lowered positions, making them more accessible and improving the machine ergonomic characteristics.

The time needed for the machine general arrangement and its installation is reduced by the fact that the coupling to working units situated upstream and downstream is in this way immediate, since there are no operations of adaptation of the conveying lines of articles and already filled boxes, according to the environment position of the machine and said working units.

It is understood that what above has been described as a not limiting example, therefore possible constructive and functional variants are meant as included in the protective scope of the following claims.

What is claimed is:

1. A machine for packaging articles into boxes, said machine including:

at least one magazine of blanks in flat folded tubular configuration, having lateral flaps and closing wings;

an inlet station situated near said magazine of blanks;

blank withdrawing means for withdrawing and opening the blanks, so as to obtain boxes with open ends;

a conveying line for the boxes, situated with an initial part in correspondence to the inlet station;

a feeding line of the articles to be placed into the boxes along said conveying line;

article withdrawing means for withdrawing articles from the articles feeding line and for introducing the articles into the boxes;

boxes closing means, acting along said conveying line;

a box discharge station for discharging the boxes filled with the articles, situated at an end of said conveying line; wherein:

said articles feeding line extends beside the machine according to different possible configurations, to allow said machine to couple with working units arranged aligned or perpendicular therewith;

said box discharge station for discharging boxes filled with the articles includes a first outlet line, arranged at 90 degrees with respect to the boxes conveying line, and a second additional outlet section, that can be arranged aligned or at 90 degrees with respect to said outlet line, to make the boxes leave in alignment or at right angle to the longitudinal extension of the machine, and, wherein said means for withdrawing and placing the articles act in such a way as to introduce the product into the boxes in a vertical direction.

2. A machine for packaging articles into boxes, said machine including:

at least one magazine of blanks in flat folded tubular configuration, having lateral flaps and closing wings;

an inlet station situated near said magazine of blanks;

blank withdrawing means for withdrawing and opening the blanks, so as to obtain boxes with open ends;

a conveying line for the boxes, situated with an initial part in correspondence to the inlet station;

a feeding line of the articles to be placed into the boxes along said conveying line;

article withdrawing means for withdrawing articles from the articles feeding line and for introducing the articles into the boxes;

boxes closing means, acting along said conveying line;

a box discharge station for discharging the boxes filled with the articles, situated at an end of said conveying line; wherein:

said articles feeding line extends beside the machine according to different possible configurations, to allow said machine to couple with working units arranged aligned or perpendicular therewith;

said box discharge station for discharging boxes filled with the articles includes a first outlet line, arranged at 90 degrees with respect to the boxes conveying line, and a second additional outlet section, that can be arranged aligned or at 90 degrees with respect to said outlet line, to make the boxes leave in alignment or at right angle to the longitudinal extension of the machine, and, wherein said magazine of cardboard blanks is shifted with respect to the conveying line, so that the dust and other impurities present between the blanks or created during the blanks handling do not fall on the already opened boxes or on the conveying line.

3. A machine for packaging articles into boxes, said machine including:

at least one magazine of blanks in flat folded tubular configuration, having lateral flaps and closing wings;

an inlet station situated near said magazine of blanks;

blank withdrawing means for withdrawing and opening the blanks, so as to obtain boxes with open ends;

a conveying line for the boxes, situated with an initial part in correspondence to the inlet station;

a feeding line of the articles to be placed into the boxes along said conveying line;

article withdrawing means for withdrawing articles from the articles feeding line and for introducing the articles into the boxes;

boxes closing means, acting along said conveying line;

a box discharge station for discharging the boxes filled with the articles, situated at an end of said conveying line; wherein:

said articles feeding line extends beside the machine according to different possible configurations, to allow said machine to couple with working units arranged aligned or perpendicular therewith;

said box discharge station for discharging boxes filled with the articles includes a first outlet line, arranged at 90 degrees with respect to the boxes conveying line, and a second additional outlet section, that can be arranged aligned or at 90 degrees with respect to said outlet line, to make the boxes leave in alignment or at right angle to the longitudinal extension of the machine, and, wherein said conveying line includes an access section, formed by two runs, that can be oriented independently from each other on a horizontal plane, and a closed, loop-like terminal section, that joins the two runs of said access section and that passes in a region corresponding to said means for withdrawing the articles from the line, for feeding articles and for introducing the articles into the boxes.

4. A machine, according to claim 3, wherein said means for withdrawing and opening the blanks include a horizontal shaft, whose one end has, hinged thereto, an oscillating arm, operated by an actuator, that moves it from a position, in which it is aligned with the shaft, so as to form its extension along the longitudinal axis, and a position, in which the arm is inclined by 90 degrees with respect to the shaft, with a plate hinge coupled to the oscillating arm and fastened, with one end, to arrangement correcting means, that determine oscillation of the arm on a plane parallel to the oscillating arm extension, while the other end of the plate carries a gripping arm, with suction cups fastened to said gripping arm for holding a wall of a blank.

5. A machine, according to claim 4, wherein said arrangement correcting means include a linear actuator and a stem for joining the jack with the plate.

6. A machine, according to claim 3, wherein boxes obtained from the opened blanks are held with one open end turned upwards.

7. A machine, according to claim 3, further including extracting means in said discharge station to make the boxes leave respective holding modules during a stop of each holding module.

8. A machine, according to claim 7, wherein said extracting means include a pusher, operated in a direction, transversal with respect to forward movement direction of said conveying line.

9. A machine, according to claim 3, wherein said conveying line includes a series of holding modules for receiving and holding said boxes with each holding module of said holding modules including a fore prong and a rear prong, with said holding modules being fastened to a belt extending along an endless path and arranged with the longitudinal symmetry plane being inclined, so that a lower backward run is shifted with respect to an upper active run, leaving a free access to the lower end of the boxes conveyed by the withdrawing devices of the upper run.

10. A machine, according to claim 9, wherein the lower backward run of the conveying line extends on a path shifted with respect to the upper active run, so as to leave a free area below the conveyed boxes and to limit vertical extension of said endless belt.

11. A machine, according to claim 9, wherein each holding module of said holding modules includes elastic tightening means for maintaining said fore prong and said rear prong elastically each time at a distance equal to a longitudinal dimension of said boxes, for allowing said fore prong and said rear prong to get to an opening position, when they are in the inlet station, to receive a box, and in the discharge station to allow removal of the box received in said inlet station.

12. A machine, according to claim 11, wherein first opening means are provided in the inlet station and second opening means are provided in the discharge station, to open the first prong and the second prong.

13. A machine, according to claim 11, wherein extraction means are provided in said discharge station, so as to make the boxes leave the respective holding modules during the stop of each holding module and the opening of the prongs.

14. A machine, according to claim 9, wherein said conveying line includes a support member for supporting, in motion, boxes conveyed by said conveying line and aimed at receiving lateral flaps for closing the boxes.

15. A machine, according to claim 14, wherein said support member includes a conveying belt, operated with a forward speed as the conveying line.

16. A machine, according claim 3, wherein said boxes closing means include first closing means for said boxes lower flaps, arranged in correspondence to an inlet end of said conveying line, and second closing means, acting on the upper flaps and on the upper closing wing and the lower closing wing of the boxes and situated downstream of said means for picking up and placing articles into the boxes.

17. A machine, according to claim 16, wherein said second closing means include additional closing means for closing said lower closing wing of the boxes.

18. A machine, according to claim 16, wherein before the second closing means there are printing means for obtaining a print on the lower closing flap of the boxes.

19. A machine, according to claim 16, further including additional closing means for closing the supports of ribbed material, before closing said boxes.

20. A machine, according to claim 19, wherein said leaflets placing means include a moving articulated arm, oscillating on a horizontal plane between a withdrawing position, situated in correspondence to the informative leaflets magazine, and a first or a second release position, selected according to the selected configuration, respectively in a position corresponding to said means for withdrawing and placing articles, so as to place an informative leaflet on a box before the introduction of article, and downstream of said means for withdrawing and placing said articles, so as to place an informative leaflet above an article, already placed into a box.

21. A machine, according to claim 3, further including means for placing informative leaflets, situated along said conveying line and near said means for withdrawing and placing articles, for withdrawing an informative leaflet from a related magazine and for placing it in a box, according to two configurations, that can be activated by choice.

22. A machine, according to claim 3, wherein said magazines of cardboard blanks, or blanks of ribbed material, and of informative leaflets are shifted with respect to the conveying line, as well as with respect to article withdrawing and placing means and to the leaflets placing means, so that the dust and other impurities present between the blanks or created during the blanks handling do not fall on the already opened boxes, or on the articles, or on the conveying line.

23. A machine, according to claim 3, wherein said means for withdrawing and opening the blanks and said boxes conveying line are operated with such movements as to prevent rubbing of the boxes external walls during the boxes handling.

24. A machine, according to claim 3, wherein said conveying line is operated stepwise.

25. A machine for packaging articles into boxes, said machine including:

at least one magazine of blanks in flat folded tubular configuration, having lateral flaps and closing wings;

an inlet station situated near said magazine of blanks;

blank withdrawing means for withdrawing and opening the blanks, so as to obtain boxes with open ends;

a conveying line for the boxes, situated with an initial part in correspondence to the inlet station;

a feeding line of the articles to be placed into the boxes along said conveying line;

article withdrawing means for withdrawing articles from the articles feeding line and for introducing the articles into the boxes;

boxes closing means, acting along said conveying line;

a box discharge station for discharging the boxes filled with the articles, situated at an end of said conveying line; wherein:

said articles feeding line extends beside the machine according to different possible configurations, to allow said machine to couple with working units arranged aligned or perpendicular therewith;

said box discharge station for discharging boxes filled with the articles includes a first outlet line, arranged at 90 degrees with respect to the boxes conveying line, and a second additional outlet section, that can be arranged aligned or at 90 degrees with respect to said outlet line, to make the boxes leave in alignment or at right angle to the longitudinal extension of the machine, and, further including at least one additional magazine, aimed at containing blanks of ribbed material for obtaining supports to be introduced into the boxes before introduction of the articles.

26. A machine, according to claim 25, wherein, near said magazine of blanks made of ribbed material, there are means for withdrawing and placing said blanks of ribbed material, aimed at withdrawing the blanks, shaping and placing them into the boxes.

27. A machine for packaging articles into boxes, said machine including:

at least one magazine of blanks in flat folded tubular configuration, having lateral flaps and closing wings;

an inlet station situated near said magazine of blanks;

blank withdrawing means for withdrawing and opening the blanks, so as to obtain boxes with open ends;

a conveying line for the boxes, situated with an initial part in correspondence to the inlet station;

a feeding line of the articles to be placed into the boxes along said conveying line;

article withdrawing means for withdrawing articles from the articles feeding line and for introducing the articles into the boxes;

boxes closing means, acting along said conveying line;

a box discharge station for discharging the boxes filled with the articles, situated at an end of said conveying line; wherein:

said articles feeding line extends beside the machine according to different possible configurations, to allow said machine to couple with working units arranged aligned or perpendicular therewith;

said box discharge station for discharging boxes filled with the articles includes a first outlet line, arranged at 90 degrees with respect to the boxes conveying line, and a second additional outlet section, that can be arranged aligned or at 90 degrees with respect to said outlet line, to make the boxes leave in alignment or at right angle to the longitudinal extension of the machine, and, further including loading means, situated between said blanks withdrawing means and said conveying line, and formed by a head, provided with suction cups and moving in a direction, transversal with respect to the forward movement direction between a forward position, for the head to withdraw a box from said withdrawing means, and a backward position in which the withdrawn box is situated between two prongs of a dwelling holding module, with possibility of a further backward movement, so as to remove said suction cups from said box and to free said holding module movement.

* * * * *